United States Patent [19]

Keane

[11] 4,000,062

[45] Dec. 28, 1976

[54] MAGNETIC PARTICLE SEPARATOR

[75] Inventor: David D. Keane, Lake Elmo, Minn.

[73] Assignee: Minnesota Mining and Manufacturing Company, St. Paul, Minn.

[22] Filed: Apr. 21, 1975

[21] Appl. No.: 569,872

[52] U.S. Cl. ..... 209/38; 209/227; 210/222

[51] Int. Cl.[2] ..... B03C 1/30

[58] Field of Search ..... 209/227, 38, 223 R, 209/219, 220; 210/223, 222, 232, 231; 51/7; 118/620

[56] References Cited

UNITED STATES PATENTS

| | | | |
|---|---|---|---|
| 1,605,117 | 11/1926 | Koizumi | 209/227 X |
| 2,062,545 | 12/1936 | Weis | 209/38 X |
| 2,366,451 | 1/1945 | McNeal | 210/223 |
| 3,608,718 | 9/1971 | Aubrey | 209/223 R |
| 3,684,090 | 8/1972 | Kilbride | 209/227 X |
| 3,848,363 | 11/1974 | Louness | 51/7 |

FOREIGN PATENTS OR APPLICATIONS

| | | | |
|---|---|---|---|
| 160,430 | 1/1938 | Austria | 209/223 R |
| 160,503 | 2/1938 | Austria | 209/223 R |
| 5,198 | 3/1908 | United Kingdom | 118/620 |
| 245,804 | 10/1969 | U.S.S.R. | 210/222 |

*Primary Examiner*—Robert Halper
*Attorney, Agent, or Firm*—Alexander, Sell, Steldt & DeLaHunt

[57] ABSTRACT

A separator for separating small permanent magnetic particles from larger objects comprising a non-magnetic perforated basket within a non-magnetic solid wall container, both within a generally vertical rotating magnetic field. The basket supports the mixture of permanent magnetic particles and objects and has perforations larger than the permanent magnetic particles and smaller than the objects. The container extends below the magnetic field to receive the magnetic particles as they are separated and to retain them outside of the influence of the magnetic field.

4 Claims, 1 Drawing Figure

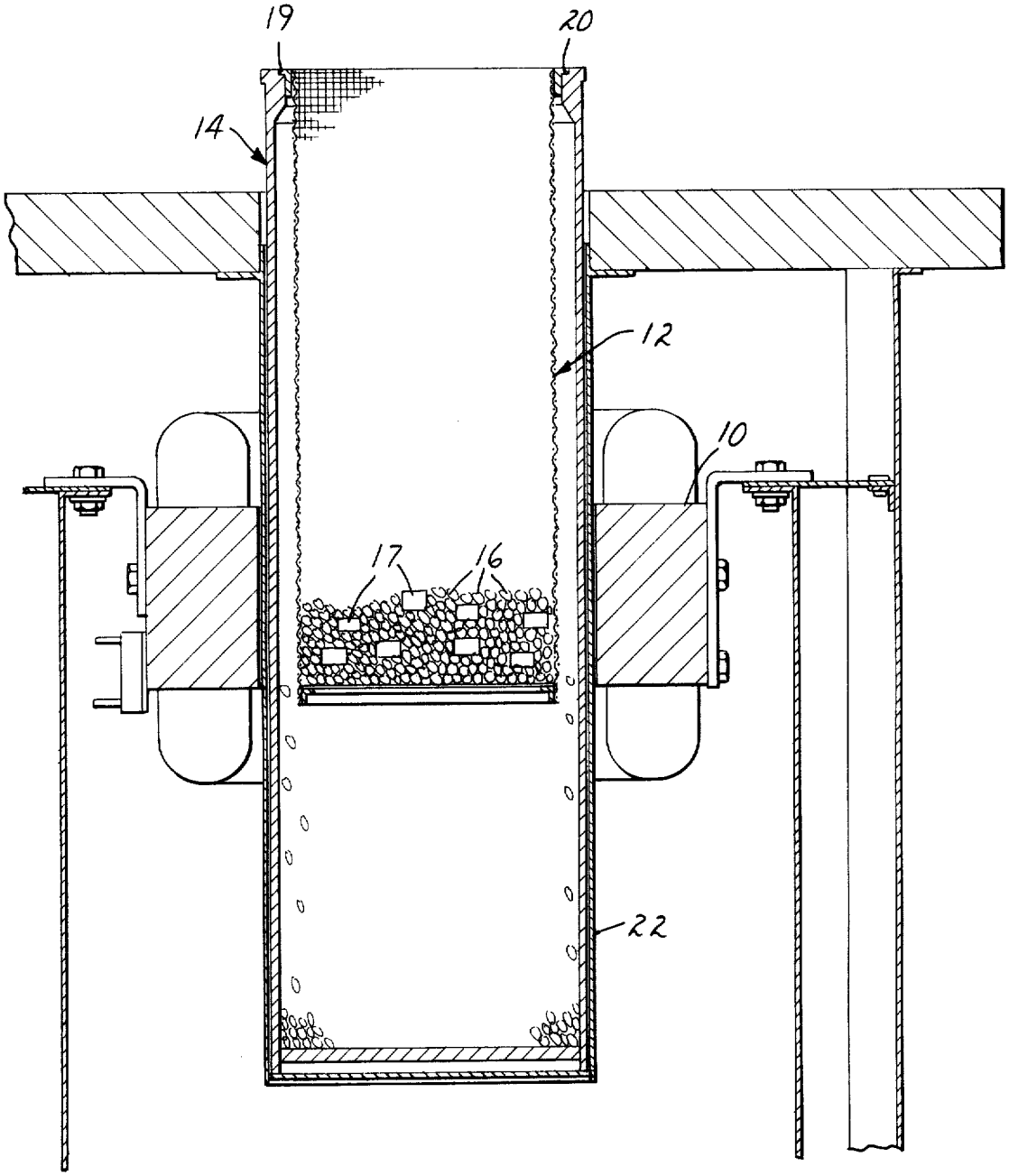
19
20
14
12
10
17
16
22

MAGNETIC PARTICLE SEPARATOR

FIELD OF THE INVENTION

The present invention relates to a separator for separating small permanent magnetic particles from larger magnetic or non-magnetic objects.

BACKGROUND OF THE INVENTION

Small permanent magnetic particles properly surface coated are used to clean, polish, abrade or surface-coat the surfaces of larger objects by subjecting them to a rotating magnetic field as taught in U.S. Pat. No. 3,848,363. The rotating magnetic field is generated by a conventional AC electric motor stator which is wound with four or more overlapping coils arranged in a generally circular pattern of opposed pairs and that are energized with two or more out of phase sources of alternating current, so that opposed coils are in phase but of opposite magnetic polarity. The permanent magnetic particles and the objects to be treated are placed in a non-magnetic container which is placed in the rotating magnetic field. The magnetic particles under the influence of the rotating magnetic field become generally uniformly distributed in the container and each particle is caused to rotate on its axis and to revolve in an orbital path about the axis of the rotating field thereby to contact and surface treat all of the intricate surfaces of the objects in the container.

After the surface treatment in the rotating magnetic field is completed and the container is removed from the field, the magnetic particles are attracted to each other and conglomerate around the treated objects thereby making separation of the objects from the magnetic particles difficult. Prior to the present invention the surface treated objects have been separated from the magnetic particles by hand, a tedious and time consuming task.

THE PRESENT INVENTION

The present invention provides a separator for automatically separating small permanent magnetic particles from larger objects. A magnetic field generator generates a rotating magnetic field in a predetermined cylindrical volume, the axis of rotation of the cylindrical volume being positioned generally vertically. A non-magnetic perforated basket is provided to support the mixture of permanent magnetic particles and objects to be separated, the perforations in the basket being larger than the magnetic particles and smaller than the objects. The basket is positioned in the rotating magnetic field and a non-magnetic solid wall, hollow container surrounds the basket within the rotating magnetic field. The interior of the container is spaced radially from the exterior of the basket and the container extends below the rotating magnetic field and has its lower end closed to define a receptacle for the magnetic particles outside of the influence of the rotating magnetic field.

THE DRAWING

The drawing is an elevation view of a magnetic particle separator constructed in accordance with the present invention with portions thereof in section for clarity.

The magnetic particle separator of the present invention comprises a rotating magnetic field generator 10, a non-magnetic wire basket 12 and a non-magnetic, solid, hollow container 14.

The rotating magnetic field generator 10 comprises a three phase AC motor stator wound with two poles per phase. The coils are energized with three out of phase sources of alternating current so that opposed coils are in phase but have opposite magnetic polarity.

The non-magnetic wire basket is cylindrical and it supports the mixture of small permanent magnetic particles 16 and larger objects 17, such as non-magnetic parts which have been surface treated. The mesh of the wire basket 12 is chosen such that the perforations or openings therein are larger than the magnetic particles 16 and smaller than the objects 17 from which the magnetic particles are to be separated.

The non-magnetic, solid wall, hollow container 14 is cylindrical, having an internal diameter somewhat greater than the external diameter of the wire basket 12. The container 14 has a substantially greater axial length than the wire basket 12.

The wire basket 12 is formed at its open end with a circumferential rim 19 corresponding to an internal circumferential ledge 20 formed on the container 14 to support the wire basket 12 coaxially with the container 14.

A thin-wall, hollow, close-ended guide and support cylinder 22 having an interior diameter slightly greater than the exterior diameter of the container 14 is stationarily mounted with respect to the magnetic field generator 10 and extends therethrough to a position significantly below the magnetic field. The container 14 fits within the guide and support cylinder 22 and its length is greater than that of the guide and support cylinder 22 so that it will extend therefrom for easy removal.

The container 14 in the position illustrated in the drawing is supported by the guide and support cylinder 22 and extends significantly below the rotating magnetic field to define a receptacle for the magnetic particles 16 outside of the influence of the rotating magnetic field. The wire basket 12 supported by the container 14 is positioned with its closed end in the rotating magnetic field.

When the magnetic field generator 10 is activated, the magnetic particles tend to uniformly distribute themselves within the rotating magnetic field as they would in the normal surface treating usage. Some of the magnetic particles of course migrate through the openings in the wire basket 12 to fill the entire volume out to the solid wall of the container 14.

It has now been found that the movement of the magnetic particles is sufficiently random that those particles migrating out of the wire basket 12 will eventually randomly move downward sufficiently out of the influence of the rotating magnetic field so that the force of gravity will oercome the field force and the magnetic particles will fall to the bottom of the container 14. Since the bottom of the container 14 is outside of the influence of the magnetic field those separated particles will remain at the bottom of the container 14. It has further been found that there is a greater probability for the magnetic particles to migrate out of the wire basket 12 and fall to the bottom of the container 14. It has been found that the speed of the random movement of the particles falling to the bottom of the container and migration of further particles radially outward is sufficiently rapid to provide a practical device for separating the magnetic particles 16 from the surface treated parts 17. In one experiment 300 grams of barium ferrite magnetic particles 0.06 inch and less in size were separated from approximately ¼ inch square and 0.125 inch thick non-magnetic parts using a wire basket 12 with 0.125 inch by 0.1 inch openings over a period of approximately 1 minute.

I claim:

1. A separator for separating small permanent magnetic particles from larger objects comprising:

means for generating a rotating magnetic field in a predetermined cylindrical volume, the axis of rotation of said cylindrical volume being positioned generally vertically, a stationary non-magnetic perforated basket for supporting the mixture of permanent magnetic particles and objects, said basket having perforations larger than the magnetic particles and smaller than the objects from which the magnetic particles are to be separated, said basket being positioned in said rotating magnetic field, a non-magnetic, solid wall, hollow container surrounding said basket within said rotating magnetic field, the interior of said container being spaced radially from the exterior of said basket, said container extending below said rotating magnetic field and having its lower end closed to define a receptacle for the magnetic particles outside of the influence of said rotating magnetic field.

2. The separator of claim 1 wherein said basket and said container are cylindrical.

3. The separator of claim 1 including a stationary support to removably support said container and wherein said container is formed to removably support said basket in said rotating magnetic field when said container is supported by said support.

4. The separator of claim 3 wherein said stationary support comprises a non-magnetic hollow cylinder within said rotating magnetic field to guide said container supporting said basket into proper position in said rotating magnetic field and to there support said container.

* * * * *